US006582763B1

(12) United States Patent
Nishimura et al.

(10) Patent No.: US 6,582,763 B1
(45) Date of Patent: Jun. 24, 2003

(54) PROCESS FOR PRODUCING OXIDE COATED FINE METAL PARTICLES

(75) Inventors: Keiichi Nishimura, Saitama-ken (JP); Takashi Fujii, Saitama-ken (JP); Kazuhiro Yubuta, Saitama-ken (JP); Sadao Shinozaki, Saitama-ken (JP)

(73) Assignees: Nisshin Seifun Group Inc., Tokyo (JP); Nisshin Engineering Inc., Tokyo (JP)

( * ) Notice: Subject to any disclaimer, the term of this patent is extended or adjusted under 35 U.S.C. 154(b) by 0 days.

(21) Appl. No.: 09/494,512

(22) Filed: Jan. 31, 2000

(30) Foreign Application Priority Data

Jan. 29, 1999 (JP) ..... 11-021610

(51) Int. Cl.[7] ..... B05D 3/04; B05D 3/14; B32B 5/16

(52) U.S. Cl. ..... 427/216; 427/533; 427/557; 427/576; 428/403

(58) Field of Search ..... 428/403; 427/212, 427/533, 557, 576, 216

(56) References Cited

U.S. PATENT DOCUMENTS

| | | | | | |
|---|---|---|---|---|---|
| 4,162,986 | A | * | 7/1979 | Alkaitis et al. | 252/33.2 |
| 5,489,449 | A | * | 2/1996 | Umeya et al. | 427/450 |
| 5,536,485 | A | | 7/1996 | Kume et al. | |
| 5,741,372 | A | * | 4/1998 | Gugel | 148/276 |
| 5,753,025 | A | * | 5/1998 | Bettler et al. | 106/442 |
| 5,846,600 | A | * | 12/1998 | Yamada et al. | 427/213 |
| 6,024,909 | A | | 2/2000 | Yoshida et al. | |
| 6,024,915 | A | | 2/2000 | Kume et al. | |
| 6,054,220 | A | * | 4/2000 | Mroz | 428/403 |
| 6,150,022 | A | * | 11/2000 | Coulter et al. | 428/403 |
| 6,162,497 | A | * | 12/2000 | Beane et al. | 427/215 |
| 6,193,794 | B1 | * | 2/2001 | Schmid et al. | 106/415 |
| 6,268,054 | B1 | * | 7/2001 | Costantino et al. | 428/403 |

FOREIGN PATENT DOCUMENTS

| | | |
|---|---|---|
| JP | 375302 | 3/1991 |
| JP | 753268 | 2/1995 |
| JP | 754008 | 2/1995 |
| JP | 8253851 | 10/1996 |
| JP | 8253853 | 10/1996 |

* cited by examiner

*Primary Examiner*—H. Thi Le
(74) *Attorney, Agent, or Firm*—Young & Thompson

(57) ABSTRACT

The oxide coated fine metal particles include fine core metal particles that are covered with a coating layer including an oxygen-containing compound of a dissimilar element that do not contain as a main component a metal element which is the main component of the fine core metal particles, or a complex oxide or a complex salt of the oxide, the complex oxide or the oxy-acid salt and an oxide of the metal element. A metal powder material is mixed with an oxide powder material of the oxygen-containing compound to obtain a powder material mixture. The powder material mixture is supplied into a thermal plasma to make a vapor-phase mixture and then the vapor-phase mixture is quenched to form the oxide coated fine metal particles comprising the fine core metal particles that are finer than the metal powder material and which are covered with the coating layer including the oxygen-containing compound.

12 Claims, 9 Drawing Sheets

FIG. 3
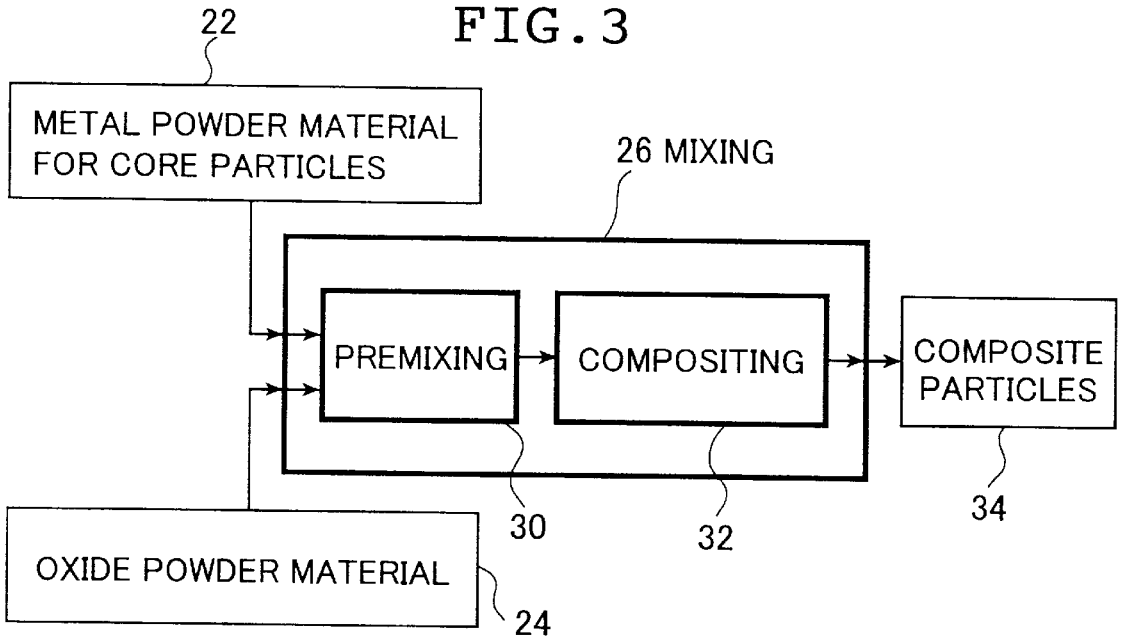
FIG. 4A
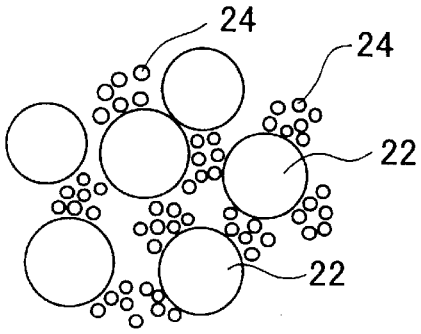
FIG. 4B
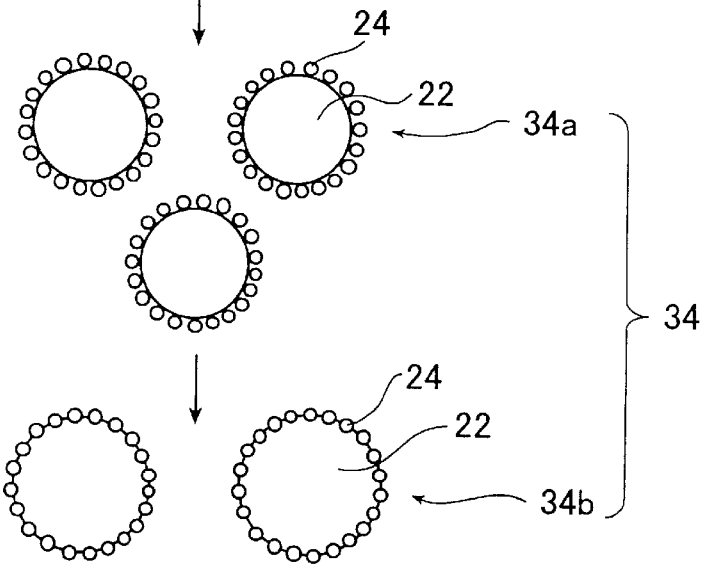
FIG. 4C

| Element | Counts | K-rel x,Si | K-std x,Si | Wt % | Atom % |
|---|---|---|---|---|---|
| Ti-K | 774 | 1.159 | --- | 5.08 | 5.87 |
| Fe-K | 12020 | 1.396 | --- | 94.92 | 94.13 |
| Total | | | | 100.00 | 100.00 |

| Element | Counts | K-rel x,Si | K-std x,Si | Wt % | Atom % |
|---|---|---|---|---|---|
| Ti-K | 13 | 1.159 | ---- | 0.09 | 0.11 |
| Fe-K | 11485 | 1.396 | ---- | 99.91 | 99.89 |
| Total | | | | 100.00 | 100.00 |

| Element | Counts | K-rel x,Si | K-std x,Si | Wt % | Atom % |
|---|---|---|---|---|---|
| Si-K | 76 | 1.000 | --- | 0.25 | 0.52 |
| Ni-K | 19371 | 1.568 | --- | 99.35 | 99.30 |
| Ba-L | 64 | 1.807 | --- | 0.38 | 0.16 |
| Ti-K | 5 | 1.159 | --- | 0.02 | 0.02 |
| Total | | | | 100.00 | 100.00 |

| Element | Counts | K-rel | K-std | Wt % | Atom % |
|---|---|---|---|---|---|
| | | x,Si | x,Si | | |
| Si-K | 109 | 1.000 | --- | 2.93 | 7.51 |
| Ni-K | 239 | 1.568 | --- | 10.08 | 12.35 |
| Ba-L | 1062 | 1.807 | --- | 51.63 | 27.04 |
| Ti-K | 1134 | 1.159 | --- | 35.36 | 53.10 |
| Total | | | | 100.00 | 100.00 |

PROCESS FOR PRODUCING OXIDE COATED FINE METAL PARTICLES

BACKGROUND OF THE INVENTION

This invention relates to oxide coated fine metal particles which comprise fine core metal particles coated with an oxide, a complex oxide or an oxy-acid salt of a dissimilar metal or a complex oxide or a complex salt of oxides of the core metal and a dissimilar metal. The invention also relates to a process for producing such oxide coated fine metal particles.

Heretofore, coated metal particles comprising core particles made of inorganic materials such as diamond and ceramics or metals and which are coated with various metallic materials or inorganic materials such as ceramics, oxides, carbides and nitrides that serve as sintering aids or thermal spraying aids have been used in diverse fields including the manufacture of sinters such as electrical insulating materials (e.g., semiconductor substrates, printed wiring circuit boards and various other electrically insulated components), machining materials of high hardness and precision (e.g., cutting tools, dies and bearings), functional devices (e.g. grain boundary capacitors and humidity sensors) and precision sintered moldings, as well as the manufacture of thermal sprayed parts such as engine valves that require wear resistance at elevated temperatures. The use of such coated particles contributes to increase not only the strength of bond between dissimilar ceramics or metals in sinters and thermal sprayed parts but also their denseness.

Unexamined Published Japanese Patent Application (kokai) No. 253851/1996 discloses a composite powder for thermal spray having an average particle size of 10–150 $\mu$m. that comprises Ti particles having a Ni coating layer of 5 $\mu$m or more with the ratio between the size of Ti particles and the thickness of Ni layer being no more than 10. Unexamined Published Japanese Patent Application (kokai) No. 253853/1996 discloses a composite powder for thermal spray comprising Co—Cr based alloy particles with an average size of 20–99 $\mu$m that are coated with partly embedded WC particles having an average size of 0.5–20 $\mu$m. To produce these composite powders for thermal spray, the powders of the two starting materials are confined in a stirring vessel either directly or after being mixed uniformly with a mixer and thereafter agitated with a stirrer so that the coating particles are mechanically urged and compressed against the core particles, thereby achieving mechanical coating of the latter.

Commonly assigned Unexamined Japanese Patent Application (kokai) Nos. 75302/1991, 53268/1995–54008/1995, etc. disclose coated particles comprising the particles of an inorganic or metallic material with an average size of 0.1–100 $\mu$m that are coated with the superfine particles of a similar or dissimilar inorganic or metallic material having an average size of 0.005–0.5 $\mu$m, as well as processes for producing such coated particles. The processes disclosed in these patents comprise the steps of generating the superfine particles by a vapor-phase method such as a thermal plasma method, introducing the core particles into the stream of the generated superfine particles, and contacting the two kinds of particles in a fluid state so that the surfaces of the core particles are coated with the superfine particles.

The composite powders for thermal spray that are disclosed in Unexamined Published Japanese Patent Application Nos. 253851/1996 and 253853/1996, supra, are no more than those produced by mechanically urging and compressing coating particles such as Ni or WC particles against core particles such as Ti or Co—Cr based alloy particles until a mechanical coating is produced. The adhesion between the core and coating particles at their interface is weak and, as a further problem, the size of the core particles is as large as several micrometers to a hundred-odd micrometers and the coating particles are also limited to those which are no smaller than 0.5–20 micrometers. In addition, the core particles are metal and the disclosure about the coating particles is limited to metals and carbides thereof; in other words, the surfaces of core metal particles are not coated with an oxide of a dissimilar metal.

Speaking of the coated particles disclosed in commonly assigned Japanese Patent Application Nos. 75302/1991, 53268/1995–54008/1995, etc., supra, the coating particles are as fine as 0.005–0.5 $\mu$m in average size since they are generated by a vapor-phase method such as a thermal plasma method. However, if the core particles are very small, say, having an average size of 1 $\mu$m or less, agglomeration is likely to occur making it difficult to give monodisperse particles and, hence, effectively coated core particles. To deal with this problem, the core particles are kept as large as 0.1–100 $\mu$m in average size and coated with the superfine particles, with the result that one can produce only large coated particles. In addition, the coated particles do not have a completely surrounding film. It should also be noted that the disclosure is substantially limited to the case where the superfine coating particles are also made of metal if the core particles are made of metal; in other words, there is no teaching of coating fine metal particles with an oxide of a dissimilar metal to produce oxide coated, fine metal particles.

Unexamined Published Japanese Patent Application No. 54008/1995, supra, discloses alumina coated quasi-fine TiAl particles comprising TiAl quasi-fine core particles with an average size of 40 $\mu$m that are coated with superfine alumina ($Al_2O_3$) particles. However, the core particles are not smaller than 1 $\mu$m and the coating alumina is not an oxide of a dissimilar metal, but similar to the metal in the main component of the core particles.

As described above, the coated particles available to date comprise large core particles, use metal coatings if the core particles are made of metal, and apply inorganic coatings if the core particles are made of inorganic materials. These coated particles are useful in sinters and thermal sprayed parts of the types described above but are not suitable for use in artificial bones with which strength and biocompatibility are two major concerns, and electrode materials in fuel cells that require high strength and good adhesion to various inorganic materials. Therefore, it has been strongly desired to develop oxide coated fine metal particles comprising fine metal particles coated with an oxide of a dissimilar metal.

SUMMARY OF THE INVENTION

The present invention has been accomplished under these circumstances and has as an object providing novel oxide coated fine metal particles comprising fine core metal particles that are coated ruggedly, preferably over the entire surfaces, with an oxide that does not contain as a main component the metal element which is the main component of the fine core metal particles.

Another object of the invention is to provide a process for producing the novel oxide coated fine metal particles in a positive and easy way.

The first object of the invention can be attained by oxide coated fine metal particles comprising fine core metal particles that are covered with a coating layer comprising either an oxide, a complex oxide or an oxy-acid salt that do not contain as a main component a metal element which is the main component of a fine core metal particles, or a complex oxide or a complex salt of the oxide, the complex oxide or the oxy-acid salt and an oxide of the metal element.

Preferably, the core particles have an average size of 0.01–1 $\mu$m and the coating layer has an average thickness of 1–10 nm.

In a preferred embodiment, the metal element which is the main component of the fine core metal particles is at least one member of the group consisting of Al, Ti, V, Cr, Fe, Co, Ni, Mn, Cu, Zn, Zr, Ru, Pd, Ag, In, Pt, Au and Sm, and wherein the oxide, the complex oxide or the oxy-acid salt with which the fine core metal particles are coated is at least one member of the group consisting of titanium oxide, zirconium oxide, calcium oxide, silicon oxide, aluminum oxide, silver oxide, iron oxide, magnesium oxide, manganese oxide, yttrium oxide, cerium oxide, samarium oxide, beryllium oxide, barium titanate, lead titanate, lithium aluminate, yttrium vanadate, calcium phosphate, calcium zirconate, lead titanate zirconate, iron titanium oxide, cobalt titanium oxide and barium stannate.

The second object of the invention can be attained by a process for producing oxide coated fine metal particles, comprising the steps of: mixing a metal powder material with an oxide powder material of an oxide, a complex oxide or an oxy-acid salt that do not contain as a main component a metal element which is the main component of the metal powder material to obtain a powder material mixture; supplying the powder material mixture into a thermal plasma to make a vapor-phase mixture; and then quenching the vapor-phase mixture to form oxide coated fine metal particles comprising fine core metal particles that are finer than the metal powder material and which are covered with a coating layer comprising either the oxide, the complex oxide or the oxy-acid salt, or a complex oxide or a complex salt of the oxide, the complex oxide or the oxy-acid salt and an oxide of the metal element.

Preferably, the core particles have an average size of 0.01–1 $\mu$m and the coating layer has an average thickness of 1–10 nm.

In a preferred embodiment, the metal element which is the main component of the fine core metal particles is at least one member of the group consisting of Al, Ti, V, Cr, Fe, Co, Ni, Mn, Cu, Zn, Zr, Ru, Pd, Ag, In, Pt, Au and Sm, and wherein the oxide, the complex oxide or the oxy-acid salt with which the fine core metal particles are coated is at least one member of the group consisting of titanium oxide, zirconium oxide, calcium oxide, silicon oxide, aluminum oxide, silver oxide, iron oxide, magnesium oxide, manganese oxide, yttrium oxide, cerium oxide, samarium oxide, beryllium oxide, barium titanate, lead titanate, lithium aluminate, yttrium vanadate, calcium phosphate, calcium zirconate, lead titanate zirconate, iron titanium oxide, cobalt titanium oxide and barium stannate.

Preferably, the metal powder material has an average particle size of 0.5–20 $\mu$m and more preferably, all the particles in the feed are 20 $\mu$m and smaller; the oxide powder material has preferably an average particle size of 0.1–1 $\mu$m.

In a preferred embodiment, the metal powder material and the oxide powder material are mixed with a high-speed shear and impact mixer or a milling mixer. In another preferred embodiment, the powder material mixture of the metal powder material and the oxide powder material is an aggregate of composite particles having the individual particles in the metal powder material coated with the oxide powder material.

Preferably, the thermal plasma has a higher temperature than boiling points of the metal powder material and the oxide powder material.

In a preferred embodiment, the thermal plasma is in an atmosphere at 760 mmHg or below. In another preferred embodiment, the thermal plasma is in an atmosphere at 200–600 Torr.

Preferably, the vapor-phase mixture is quenched in an inert or reducing atmosphere; it is also preferred that the vapor-phase mixture is quenched in an atmosphere containing a rare gas either independently or in admixture with hydrogen.

BRIEF DESCRIPTION OF THE DRAWINGS

FIG. 3 is a block diagram for an example of the mixing step in the process shown in FIG. 2;

FIGS. 4A–4C illustrate how particles are composited in the mixing step shown in FIG. 3;

DETAILED DESCRIPTION OF THE INVENTION

The oxide coated fine metal particles of the invention and the process for producing them are described below in detail with reference to the preferred embodiments shown in the accompanying drawings.

Figure 1:
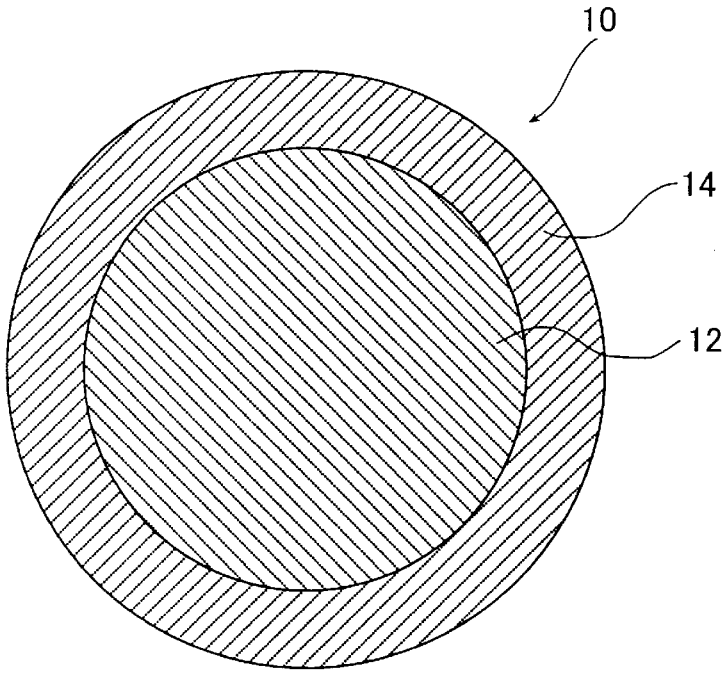
FIG. 1 is a schematic cross section of an exemplary oxide coated fine metal particle according to the invention.

FIG. 1 is a schematic cross section of an exemplary oxide coated fine metal particle according to the invention. As shown, the oxide coated fine metal particle (hereunder referred to simply as "coated particle") which is generally indicated by 10 comprises a fine core metal particle 12 and an oxide coating layer 14 comprising an oxygen-containing compound of a dissimilar element such as an oxide that does not contain as a main component the metal element which is the main component of the fine core metal particle 12 or a complex oxide of said oxide and an oxide of said metal element.

The fine core metal particle 12 which serves as the core of the coated particle 10 may comprise a single metal or an alloy of two or more metals and a suitable type can be selected in accordance with the intended use of the coated particle 10. For example, the metal element which is the main component of the fine core metal particle 12 may be at least one element of the group consisting of Al, Ti, V, Cr, Fe, Co, Ni, Mn, Cu, Zn, Zr, Ru, Pd, Ag, In, Pt, Au and Sm. More specifically, these metals may be used either in their elementary form or as various intermetallic compounds or as alloys of two or more of them, as exemplified by Fi—Co—Ni, Ni—Fe, Ni—Cu, Ni—Mn, In—Ni, Al—Ti and Ti—Cu alloys; composites of these materials may also be used. In particular, Ti is preferred for use in artificial bones, Fe in additives to cosmetics and as catalysts, and Ni in electrode materials in fuel cells.

The average size of the fine core metal particles 12 is not particularly limiting as long as they are fine particles; they are preferably fine particles having an average size in the range of 0.01–1 $\mu$m, more preferably in the range of 0.1–0.5 $\mu$m.

The size distribution of the fine core metal particles 12 is not particularly limiting, either, except that it preferably has less scattering or a smaller half-width.

The oxide coating layer (hereunder referred to simply as "coating layer") 14 covers the surface, preferably the entire surface, of the fine core metal particle 12 and it is a layer of an oxide that does not contain as a main component the metal element which is the main component of the fine core metal particle 12 (which oxide may be called "a dissimilar oxide") or a complex oxide or an oxy-acid salt that both satisfy the stated condition, or it is a layer of a complex oxide or a complex salt of the element in said dissimilar oxide, complex oxide or oxy-acid salt, the metal element in the fine core metal particle 12 and oxygen.

The dissimilar oxide, complex oxide or oxy-acid salt or the complex oxide or complex salt thereof that are used in the oxide coating layer 14 (and which are hereunder collectively referred to simply as "oxide" or "oxides") are not particularly limiting and they may be any oxide, complex oxide, oxy-acid salt or complex salt, with a suitable type being selectable in accordance with the fine core metal particle 12 to be covered with the oxide coating layer 14 and the coated particle 10 to be finally produced. Examples include oxides such as titanium oxide ($TiO_2$), zirconium oxide ($ZrO_2$), calcium oxide (CaO), silicon oxide ($SiO_2$), aluminum oxide (alumina: $Al_2O_3$), silver oxide ($Ag_2O$), iron oxide, magnesium oxide (MgO), manganese oxide ($Mn_2O_7$), yttrium oxide ($Y_2O_3$), cerium oxide, samarium oxide and beryllium oxide (BeO), as well as complex oxides and oxy-acid salts such as barium (meta)titanate ($BaTiO_3$), lead titanate ($PbtiO_3$), lithium aluminate, yttrium vanadate, calcium phosphate, calcium zirconate, lead titanate zirconate, iron titanium oxide ($FeTiO_3$), cobalt titanium oxide ($CoTiO_3$) and barium stannate ($BaSnO_3$). In particular, CaO or $SiO_2$ or calcium phosphate is preferably used with Ti in artificial bones, $TiO_2$ with Fe in additives to cosmetics or as catalysts, and $ZrO_2$ or $BaTiO_3$ with Ni or Cu in electrode materials in fuel cells.

The average thickness of the coating layer 14 is not particularly limiting and may be selected as appropriate for the average size of the fine core metal particle 12 and the size and intended use of the coated particle 10; preferably, it is within the range of 1–10 nm, more preferably 3–5 nm. One of the features of the invention is that the thickness of the coating layer 14 is uniform or nearly uniform over the entire surface of the fine core metal particle 12 and, needless to say, the more uniform the thickness is, the better. However, this is not the sole case of the invention and some variation in the thickness of the coating layer 14 is permissible if its average thickness over the entire surface of the fine core metal particle 12 is within the stated range of 1–10 nm.

Having described the basic construction of the oxide coated fine metal particles of the invention according to its first aspect, we now describe the process for producing such particles according to the second aspect of the invention with reference to FIGS. 2–5.

Figure 2:
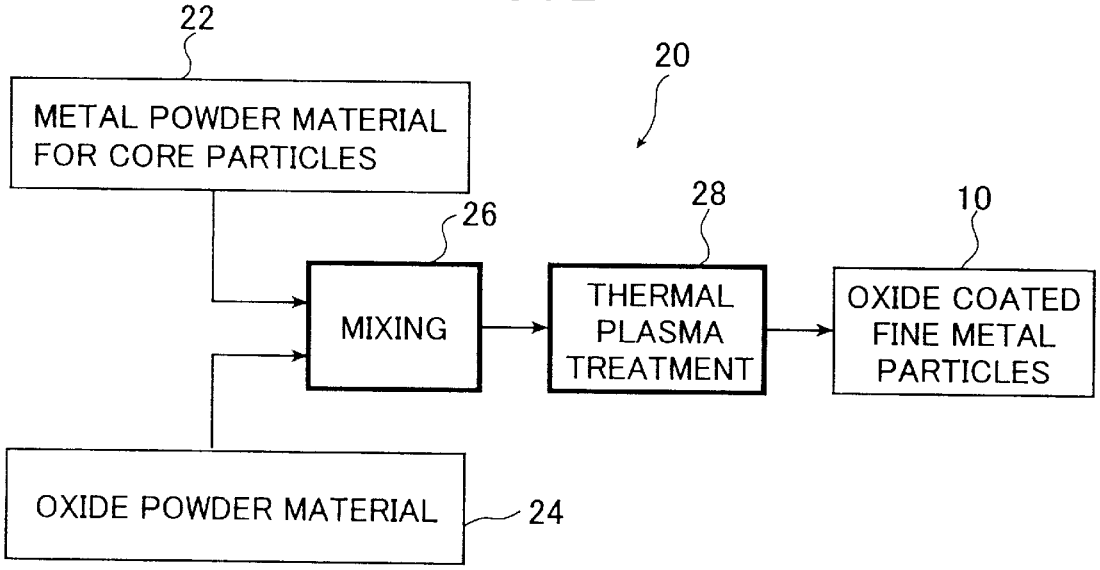
FIG. 2 is a block diagram for an example of the process of the invention for producing oxide coated fine metal particles.
Figure 5:
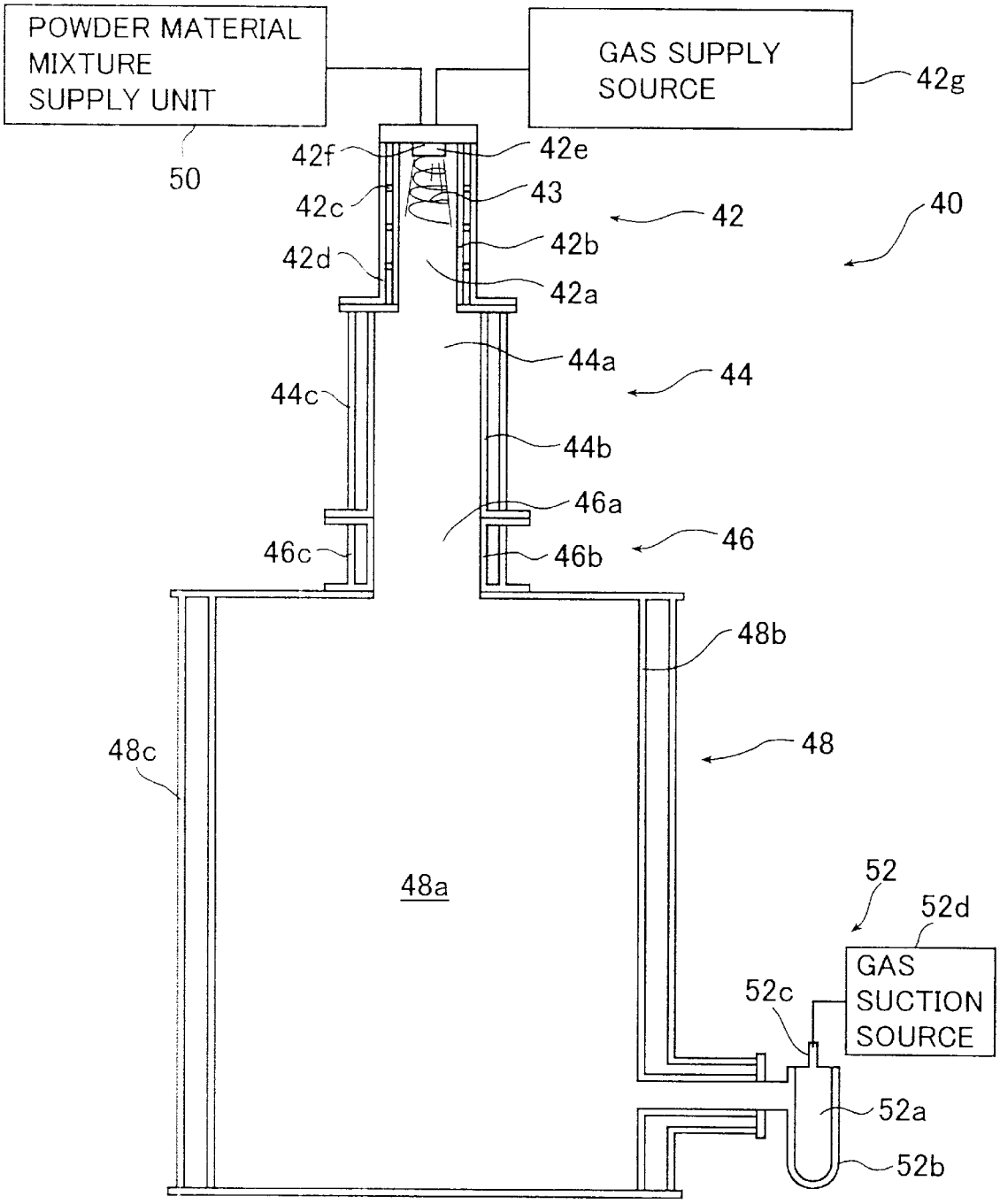
FIG. 5 is a diagrammatic vertical section of an embodiment of an apparatus for producing oxide coated fine metal particles by implementing the thermal plasma treatment in the process shown in FIG. 2.

FIG. 2 is a block diagram for an example of the process of the invention for producing oxide coated fine metal particles. FIG. 3 is a block diagram for an example of the mixing step in the process shown in FIG. 2. FIGS. 4A–4C illustrate how particles are composited in the mixing step shown in FIG. 3. FIG. 5 is a diagrammatic vertical section of an exemplary apparatus for producing oxide coated fine metal particles by implementing the thermal plasma treatment in the process shown in FIG. 2. It should, however, be noted that the process of the invention for producing oxide coated fine metal particles is by no means limited to the illustrated cases.

In FIG. 2, the basic flow of implementing the process of the invention for producing oxide coated fine metal particles is generally indicated by 20 and comprises a mixing step 26 in which a metal powder material 22 for forming the fine core metal particles 12 is mixed with an oxide powder material 24 for forming the oxide coating layer 14 and a thermal plasma treatment step 28 in which the mixture of the metal powder material 22 and the oxide powder material 24 as obtained in the mixing step 26 is treated with a thermal plasma to produce the coated particles 10 of the invention which comprise the fine metal particles 12 that have been refined from the metal powder material 22 and which are covered with the dense coating layer 14.

The metal powder material 22 used in the invention is a raw material of metal powder for supplying the metal that is to constitute the fine metal particles 12 which serve as the cores of the coated particles 10 and it is not particularly limiting as long as it is made of a metal selected from among those which have been listed above in connection with the fine metal particles 12. The average particle size of the metal powder material 22 is not particularly limiting; if the average size of the fine core metal particles 12 is within the range of 0.05–1 $\mu$m, the average particle size of the metal powder material 22 is preferably within the range of 0.5–20 $\mu$m and, more preferably, all particles in the metal powder material 22 are not larger than 20 $\mu$m.

The oxide powder material 24 used in the invention is a raw material of oxide powder for supplying the oxide, complex oxide or oxy-acid salt that are to constitute the oxide coating layer 14 of the coated particles 10 and which do not contain as a main component the metal element which is the main component of the metal powder material 22; the oxide powder material 24 is not particularly limiting as long as it is made of a compound selected from among the aforementioned oxides, complex oxides and oxy-acid salts. The average particle size of the oxide powder material 24 is not particularly limiting; if the average thickness of the coating layer 14 is within the range of 1–10 nm, the average particle size of the oxide powder material 24 is preferably within the range of 0.1 1 $\mu$m, more preferably within the range of 0.2–0.5 $\mu$m.

The mixing step 26 shown in FIG. 2 is for mixing the metal powder material 22 (which is to form the core particles 12) with the oxide powder material 24 (which is to form the coating layer 14). In the mixing step 26, any method that can mix the two powder materials 22 and 24 may be employed and it is preferred to mix them uniformly. The mixing machine to be used in the mixing step 26 is not particularly limiting and may be exemplified by known types such as a high-speed shear and impact mixer and a milling mixer.

In the mixing step 26, it is particularly preferred to composite the two powder materials 22 and 24 so that the individual particles in the metal powder material 22 are dispersed and each discrete particle is coated on the entire surface with a multiple of particles in the oxide powder material 24 that have been dispersed and attached to form composite particles having a uniform coating on all core particles.

FIG. 3 is a block diagram for an example of the mixing step for producing such composite particles.

As shown, the mixing step 26 comprises a premixing sub-step 30 in which the metal powder material 22 and the oxide powder material 24 are mixed, preferably uniformly, prior to compositing, and a compositing sub-step 32 in which the resulting premix of the two powder materials is composited to produce composite particles 34.

The premixing sub-step 30 is for preparing a uniform premix of the metal powder material 22 and the oxide powder material 24. In the premixing sub-step 30, a V-type mixer or a double-cone mixer is typically employed but any other known types of mixers may be substituted.

By using the above-mentioned mixers in the premixing sub-step 30, the metal powder material 22 and the oxide powder material 24 are uniformly mixed as in the case of ordinary mixing (see FIG. 4A), except that particles in the metal powder material 22 or, as is often the case, finer particles in the oxide powder material 24 more or less agglomerate together.

The uniform mixture of the metal powder material 22 and the oxide powder material 24 is then transferred to the compositing sub-step 32 where the particles in the two powders are composited to produce composite particles 34.

The term "compositing" as used herein has one of the following three meanings: particles in the metal powder material 22 do not agglomerate together but they are individually coated on the entire surface with a multiple of particles in the oxide powder material 24 that have been dispersed and attached to produce composite particles indicated by 34*a* in FIG. 4B; a multiple of particles in the oxide powder material 24 are dispersed, preferably uniformly, and adhered to provide a coat, preferably a uniform coat, on the entire surface of an individual particle in the metal powder material 22 such that they are partly or totally buried in the surface of each particle in the metal powder material 22, thereby producing composite particles indicated by 34*b* in FIG. 4C; and composite particles 34 which assume various states in between the composite particles 34*a* and 34*b*.

In the compositing sub-step 32, all particles in the two powder materials 22 and 24 are preferably composited so that all coated particles 10 are composite particles. Of course, this is not the sole case of the invention and the mixture of the two powder materials may partly remain to be composited.

The compositing sub-step 32 is not particularly limiting if it performs compositing of particles by a shear force, an impact force or a milling force; therefore, this can be implemented with any suitable machine such as a high-speed shear and impact mixer or a milling mixer.

The thus obtained powder material mixture (preferably containing the composite particles 34) is then sent to the thermal plasma treatment step 28, which is implemented by the apparatus for producing oxide coated fine metal particles that is shown in FIG. 5.

The apparatus generally indicated by 40 in FIG. 5 comprises a plasma torch 42 having a plasma compartment 42*a*, a sheathed quartz tube 44, a sheathed cooling tube 46, a quenching tube 48, a powder material mixture supply unit 50 and a product recovery unit 52.

The plasma torch 42 comprises a quartz tube 42*b* defining the plasma compartment 42*a* for internally generating a thermal plasma (plasma flame) 43, a radio-frequency transmitting coil 42*c* mounted around the quartz tube 42*b*, a cooling jacket tube 42*d* mounted around the RF (radio frequency) transmitting coil 42*c*, a gas outlet 42*e* that is mounted on top of the quartz tube 42*b* and through which a plasma forming gas is ejected in three directions, tangential, axial and radial, and a supply port 42*f* through which the powder material mixture is supplied into the thermal plasma 43 formed within the plasma compartment 42*a*.

The plasma torch 42 has a dual-wall structure consisting of the quartz tube 42*b* and the jacket tube 42*d*, with the coil 42*c* being inserted between them. This is not the sole case of the invention and the coil 42*c* may be wound around the jacket tube 42*d* or it may have a multiple-wall structure consisting of three or more tubes; the size of the coil 42*c* is not particularly limiting. The direction of ejecting the plasma forming gas through the gas outlet 42*e* is not limited to the three directions, tangential, axial and radial, but it may be so designed as to permit ejection in various other directions.

The gas outlet 42*e* is connected to one or more gas supply sources 42*g* that are located outside and above the plasma torch 42.

When the plasma forming gas is supplied from the gas supply source 42*g* to the gas outlet 42*e*, it is ejected from the gas outlet 42*e* into the plasma compartment 42*a* in the three directions mentioned above. The ejected plasma forming gas is exited by a RF voltage supplied from a RF power source to the RF transmitting coil 42*c*, whereby a thermal plasma 43 is formed within the plasma compartment 42*a* in the plasma torch 42.

The plasma forming gas to be supplied through the gas outlet 42*e* is limited to a rare gas such as argon or helium, a gas such as hydrogen or nitrogen, and mixtures of these gases. The volume in which these gases are supplied through the gas outlet 42*e* may be selected as appropriate for various factors including the size of the plasma compartment 42*a*, the properties of the thermal plasma 43 and the throughput of the powder material mixture.

The frequency of the RF voltage to be applied to the RF transmitting coil 42*c* and the voltage (or power) are not particularly limiting and may be selected as appropriate for various factors such as the properties, say, temperature, of the thermal plasma 43.

In order to convert the mixture of the metal powder material 22 and the oxide powder material 24 into a vapor phase, the temperature of the thermal plasma 43 has to be higher than the eutectic boiling point of the mixture. The higher the temperature of the thermal plasma 43, the easier for the mixture of the two powder materials to turn into a vapor phase and, hence, the better. However, the temperature of the thermal plasma 43 is not particularly limiting; it may be higher than the boiling points of the metal powder material 22 and the oxide powder material 24 or any other suitable temperature may be selected in accordance with the metal powder material 22 and the oxide powder material 24. To give one specific example, the temperature of the thermal plasma 43 may be higher than 6,000° C. The upper limit of the temperature of the thermal plasma 43 is not particularly limiting, either; due to the difficulty in measurement, it is not easy to determine the upper limit but theoretically it would reach as high as about 10,000° C.

The atmosphere around the thermal plasma 43 is not particularly limiting and it is preferably at 760 mmHg or below, more specifically at 200–600 Torr.

The supply port 42*f* through which the powder material mixture is to be supplied is connected to the powder material mixture supply unit 50 which is also located outside and above the plasma torch 42.

From the supply unit 50, the powder material mixture, for example, an Fe—$TiO_2$ powder mixture, preferably, composite particles 34 are supplied and introduced into the thermal plasma through the supply port 42*f* as they are borne in a carrier gas. The carrier gas for bearing the powder material mixture is limited to a rare gas such as argon or helium, a gas such as hydrogen or nitrogen and mixtures of these gases. If desired, the plasma forming gas or part of it (one or more of the gases to be mixed) may be used as a carrier gas for bearing the powder material mixture.

The powder material mixture introduced into the thermal plasma 43 is momentarily turned into a gas by the heat of the thermal plasma 43 so that in this thermal plasma 43, both the metal powder material 22 and the oxide powder material 24 in the mixture occur in a vapor phase. The volume of the powder material mixture to be supplied through the supply port 42f and the kind and volume of the carrier gas which bears the powder material mixture are not particularly limiting, either, and may be selected as appropriate for various factors such as the properties of the thermal plasma 43 and the throughput of the powder material mixture.

The sheathed quartz tube 44 is positioned under the plasmas torch 42 and comprises a quartz tube 44*b* having a larger diameter than the quartz tube 42*b* in the plasma torch 42 and a cooling jacket tube 44*c* mounted around the quartz tube 44*b*. The quartz tube 44*b* defines in its interior a cooling compartment 44*a* into which the gaseous mixture (vapor phase) of the metal powder material 22 and the oxide powder material 24 produced by heating with the thermal plasma 43 and emerging from it is introduced for primary cooling.

The sheathed cooling tube 46 is positioned under the sheathed quartz tube 44 and comprises an inner tube 46*b* of generally the same diameter as the quartz tube 44*b* in the sheathed quartz tube 44 and a cooling jacket tube 46*c* mounted around the inner tube 46*b*. The inner tube 46*b* defines in its interior a cooling compartment 46*a* for effecting secondary cooling of the metal powder material 22 and the oxide powder material 24 in a vapor-, liquid- or solid-phase that have been subjected to primary cooling in the sheathed quartz tube 44.

The quenching tube 48 is positioned under the sheathed cooling tube 46 and comprises an inner tube 48*b* much larger in diameter than the quartz tube 46*b* in the sheathed cooling tube 46 and a cooling jacket tube 48*c* mounted around the inner tube 48*b*. The inner tube 48*b* defines in its interior a coated particle generating compartment 48*a* where the metal powder material 22 and the oxide powder material 24 in a vapor-, liquid- or solid-phase that have been subjected to secondary cooling in the sheathed cooling tube 46 are quenched to generate coated particles 10 of the invention.

In the coated particle generating compartment 48*a* of the quenching tube 48, the vapor- or liquid-phase mixture of the metal powder material 22 and the oxide powder material 24 that has been subjected to secondary cooling in the sheathed cooling tube 46 is quenched so that solid-phase coated particles 10 of the invention are produced all at once from the vapor- or liquid-phase mixture of the metal powder material 22 and the oxide powder material 24. Each of the coated particles 10 comprises the fine core metal particle 12 that is more refined than the metal powder material 22 (i.e., having a smaller size than the particles in the metal powder material 22, preferably from a few tenth to a few hundredth of the size of the latter) and which is covered with the dense and uniformly thick coating layer 14 of the oxide formed from the oxide powder material 24. The coating layer 14 is made of an oxide, a complex oxide or an oxy-acid salt that do not contain as a main component the metal element which is the main component of the fine metal particles 12, provided that it may also contain an oxide, a complex oxide or an oxy-acid salt of the metal element which is the main component of the fine metal particles 12 if it maintains tight joining (bonding) or coating on the fine metal particles 12.

In order to retard or prevent the oxidation of the fine core metal particles, namely, the generation of an oxide of the metal element in them, the atmosphere in the coated particle generating compartment 48*b* of the quenching tube 48 for quenching the vapor- or liquid-phase material mixture is preferably inert or reducing. The inert or reducing atmosphere that can be used is not particularly limiting and may be exemplified by an atmosphere composed of at least one inert gas selected from among argon (Ar), helium (He) and nitrogen ($N_2$) or an atmosphere containing both such inert gas and hydrogen ($H_2$); specific examples include a rare gas atmosphere such as an argon or helium atmosphere, an inert atmosphere such as a nitrogen gas atmosphere or a mixture of argon or helium and nitrogen gas, and a reducing atmosphere such as a hydrogen-containing argon atmosphere, a hydrogen-containing helium atmosphere or a hydrogen-containing nitrogen gas atmosphere. The reducing power of these reducing atmospheres is not particularly limiting, either.

In the illustrated case, not only the plasma torch 42 but also the sheathed quartz tube 44, the sheathed cooling tube 46 and the quenching tube 48 are designed to have a dual-wall structure; however, this is not the sole case of the invention and they may have a multiple-wall structure consisting of three or more tubes and their size is not particularly limiting either.

The product recovery unit 52 is used to recover the coated particles 10 of the invention that have been generated in the coated particle generating compartment 48*a* of the quenching tube 48. This unit comprises: a recovery chamber 52*a* that is positioned outside and beside the lower part of the quenching tube 48 and which communicates with the coated particle generating compartment 48*a*; a filter 52*b* that is positioned between the recovery chamber 52*a* and the connection to the coated particle generating compartment 48*a* for separating the coated particles 10 of the invention from the fluidizing gases such as the carrier gas and the plasma forming gas; and a gas suction/exhaust port 52*c* through which only the fluidizing gases that have been aspirated together with the coated particles 10 of the invention from within the coated particle generating compartment 48*a* are discharged after separation with the filter 52*b*.

The gas suction/exhaust port 52*c* is connected to a gas suction source 52*d* which is positioned outside and above the product recovery unit 52.

The fluidizing gases that are aspirated through the port 52*c* by means of the gas suction source 52*d* comprise the plasma forming gas such as argon or nitrogen used to produce the thermal plasma 43 and the carrier gas such as argon for bearing the powder material mixture. These gases are aspirated from the coated particle generating compartment 48*a* to come into the product recovery unit 52 together with the coated particles 10 of the invention. Even if the particles produced in the coated particle generating compartment 48*a* contain not only the coated particles 10 of the invention but also incompletely coated particles as well as metal and oxide particles, these unwanted particles are completely recovered by the filter 52*b* to enter the recovery chamber 52*a* and only the fluidizing gases that have been filtered off are discharged through the suction port 52*c*.

The powder material mixture supply unit 50 is a device by which the mixture of the metal powder material 22 and the oxide powder material 24 that has been prepared by various mixing apparatus in the mixing step 26 is supplied into the thermal plasma 43 in the plasma torch 42 as it is borne by the carrier gas such as argon. Although not shown, the basic components of the supply unit 50 are a reservoir for holding the powder material mixture, a mixing compartment in which the powder material mixture from the reservoir is borne by the carrier gas, and a gas supply source for supplying the carrier gas into the mixing compartment.

In the illustrated apparatus 40 for producing oxide coated fine metal particles, the sheathed quartz tube 44 and the sheathed cooling tube 46 that perform intermediate cooling (primary and secondary) are positioned between the plasma torch 42 for converting the mixture of the metal powder material 22 and the oxide powder material 24 into a vapor phase and the quenching tube 48 that quenches the vapor-phase powder material mixture to produce the coated particles 10 of the invention. However, this is not the sole case of the invention and those intermediate cooling device may be omitted entirely, or a device of performing intermediate cooling in either one step or three or more steps may be substituted.

Having described the basic construction of the apparatus for implementing the thermal plasma treatment step 28 in the flow of producing the oxide coated fine metal particles of the invention, we now discuss the operation of the apparatus as well as the thermal plasma treatment step 28 in the production of the oxide coated fine metal particles.

First, the powder material mixture (preferably the composite particles 34) prepared in the mixing step 26 is sent to the thermal plasma treatment step 28, where it is supplied into the powder material mixture supply unit 50 in the apparatus 40 shown in FIG. 5. Throughout the thermal plasma treatment step 28, a predetermined RF voltage is applied to the RF transmitting coil 42*c* in the plasma torch 42, the plasma forming gas supplied from the gas supply source 42*g* is ejected through the gas outlet 42*e*, and the thermal plasma (plasma flame) 43 is produced and maintained in the plasma compartment 42*a*.

Subsequently, the powder material mixture is supplied from the unit 50 via the supply port 42*f* to be introduced into the thermal plasma 43 within the plasma compartment 42*a*, whereupon both the metal powder material 22 and the oxide powder material 24 in the mixture volatilize into a vapor phase.

The two materials, metal powder material 22 and oxide powder material 24, that have been turned into a vapor phase by the thermal plasma 43 go down the plasma compartment 42*a* to leave the thermal plasma 43 and enter the cooling compartment 44*a* of the sheathed quartz tube 44 where both materials undergo primary cooling; the cooled materials further descend to enter the cooling compartment 46*a* of the sheathed cooling tube 46 where they are subjected to secondary cooling.

The two materials (metal powder material 22 and oxide powder material 24) that have been converted to a vapor phase or partly to a liquid phase further descend to enter the coated particle generating compartment 48*a* of the quenching tube 48. Since the coated particle generating compartment 48*a* is by far larger than the cooling compartment 46*a* of the sheathed cooling tube 46, the two materials (metal powder material 22 and oxide powder material 24) in a vapor phase or partly in a liquid phase that have entered the coated particle generating compartment 48*a* are quenched to solidify all at once to produce coated particles 10 of the invention. Each of the coated particles 10 comprises the fine core metal particle 12 that is more refined than the metal powder material 22 (i.e., having a smaller size than the particles in the metal powder material 22, for example, a few hundredth of the size of the latter) and which is covered with the dense and uniformly thick coating layer 14 of the oxide formed from the oxide powder material 24.

In this way, one can produce the oxide coated fine metal particles 10 of the invention comprising refined core metal particles 12 each of which is densely covered on the entire surface with the coating layer 14 that is made of an oxide, a complex oxide or an oxy-acid salt which do not contain as a main component the metal element which is the main component of the fine metal particles 12, said coating layer 14 optionally containing an oxide, a complex oxide or an oxy-acid salt of the metal element which is the main component of the fine metal particles 12.

In the thermal plasma treatment step 28, the composite particles 34 prepared in the particle compositing sub-step 32 of the mixing step 26 may be substituted for the powder material mixture to be supplied from the supply unit 50 in the apparatus 40 for producing oxide coated fine metal particles and this contributes to achieve a marked increase in the yield of the coated particles 10 of the invention.

As already mentioned, the intermediate cooling performed in the process of the invention for producing oxide coated fine metal particles is not limited to the two-step cooling by the sheathed quartz tube 44 and the sheathed cooling tube 46 and it may be carried out in one step or in three or more steps.

Described above are the basic features of the process of the invention for producing oxide coated fine metal particles.

While the oxide coated fine metal particles of the invention and the process for producing them have been described above in detail, it should be noted that the invention is by no means limited to the foregoing cases and various improvements and modifications may of course be made without departing from the spirit of the invention.

As described above in detail, the first aspect of the invention has the advantage of producing novel oxide coated fine metal particles that comprise fine core metal particles covered ruggedly, preferably over their entire surfaces, with an oxide coating layer made of an oxide that does not contain as a main component the metal element which is the main component of the fine core metal particles (said coating layer may optionally contain an ordinary oxide, complex oxide or oxy-acid salt). The novel oxide coated fine metal particles are suitable for use in applications such as artificial bones, additives to cosmetics and catalysts that need fusion between metal functions (e.g. strength and magnetism) and oxide functions (e.g. environmental compatibility and photoactivity), and other applications such as electrode materials in fuel cells that need good adhesion between metal and oxide.

According to the second aspect of the invention, the novel oxide coated fine metal particles having the above-mentioned advantage can be produced in a positive and easy way, preferably in high yield.

EXAMPLES

The following examples are provided for the purpose of further illustrating the present invention but are in no way to be taken as limiting.

Example 1

An Fe powder material 22 having an average particle size of 5 $\mu$m and a $TiO_2$ powder material 24 having an average particle size of 1 $\mu$m were charged into the apparatus 40 shown in FIG. 5 and processed in accordance with the production line 20 shown in FIGS. 2 and 3 to produce $TiO_2$-coated fine Fe particles 10.

In the premixing sub-step 30 of the mixing step 26 shown in FIG. 3, a high-speed agitating mixer Hi-X (Nisshin Engineering Co., Ltd.) was used; in the particle compositing sub-step 32, a particle compositing apparatus Theta (Θ) Composer (Tokuju Kosakusho K.K.) was used.

Referring to the apparatus 40 shown in FIG. 5, the quartz tube 42*b* in the plasma torch 42, the quartz tube 44*b* in the sheathed quartz tube 44, the inner tube 46*b* of the sheathed cooling tube 46 and the inner tube 48*b* of the quenching tube 48 had the following values of inside diameter and length: 42*b* (55 mm×220 mm); 44*b* (120 mm×250 mm); 46*b* (120 mm×100 mm); 48*b* (400 mm×900 mm).

The $TiO_2$ powder material 24 and the Fe powder material 22 were supplied in such a ratio that the proportion of the $TiO_2$ powder material 24 was 4.5 wt % (8 vol %).

The RF transmitting coil 42*c* in the plasma torch 42 was supplied with a RF voltage of about 6 kV at a frequency of about 4 MHz; the plasma forming gas to be ejected through the gas outlet 42*e* was a mixture of argon (100 L/min) and hydrogen (10 L/min). Throughout the plasma treatment step, the thermal plasma 43 formed in the plasma compartment 42*a* of the plasma torch 42 was in an atmosphere at a reduced pressure of about 450 Torr.

The powder material mixture (Fe—$TiO_2$ composite particles 34) were supplied into the thermal plasma 43 in the plasma torch 42 via the supply port 42*f* at a rate of 10 g/h as they were borne by a carrier gas (argon) flowing at a rate of 5 L/min.

The atmosphere in the coated particle generating compartment 48*a* of the quenching tube 48 was a reducing one composed of hydrogen-containing argon.

By the above-described procedure, oxide coated fine metal particles 10 could be produced in high yield. They comprised the fine core Fe particles 12 having an average size of 0.3 $\mu$m that were covered with the oxide coating layer 14 in an average thickness of 5 nm which joined tightly and strongly (ruggedly) to the surfaces of the fine Fe particles 12.

Figure 6:
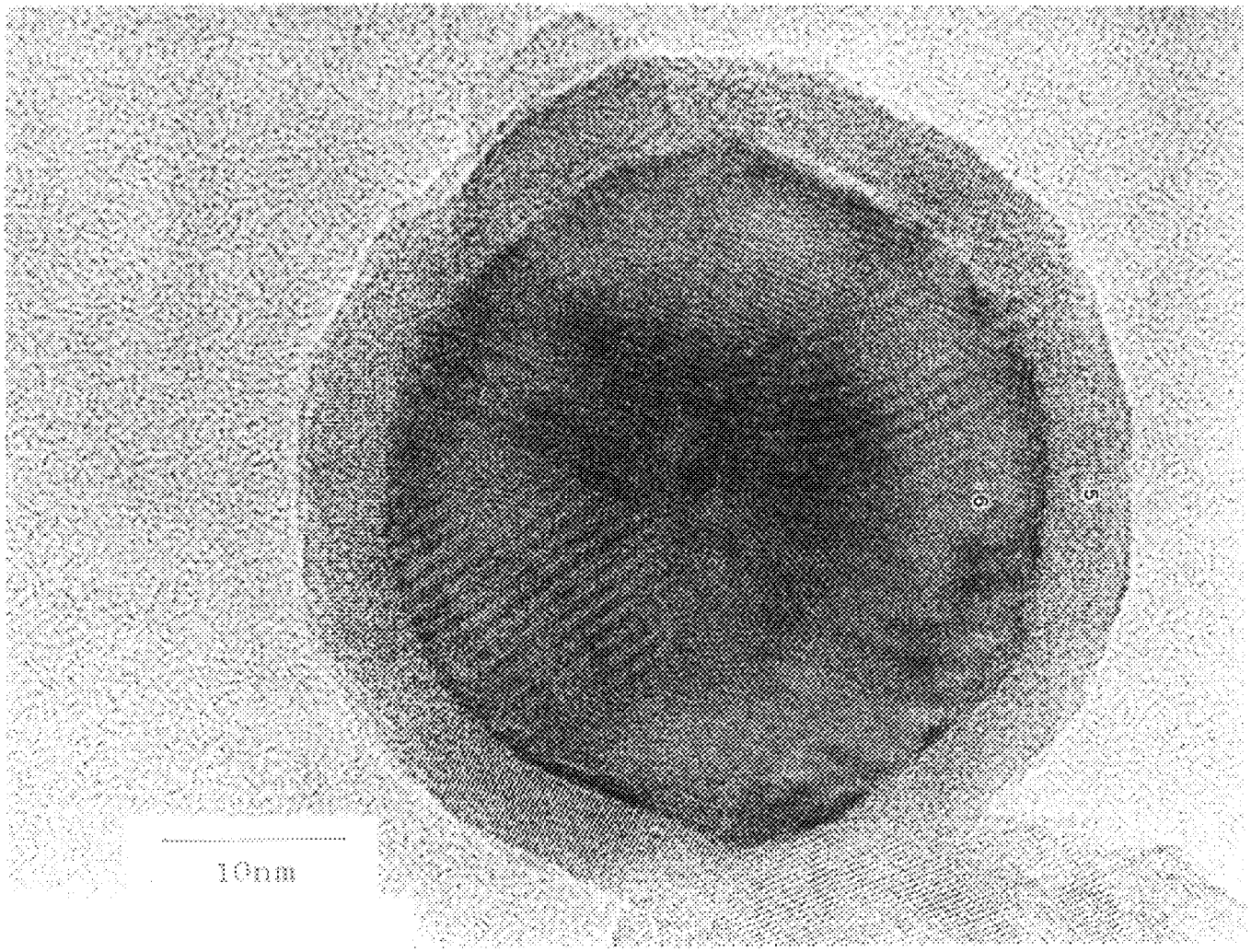
FIG. 6 is a transmission electron micrograph of one of the oxide coated fine metal particles prepared in Example 1 of the invention.
Figure 7:
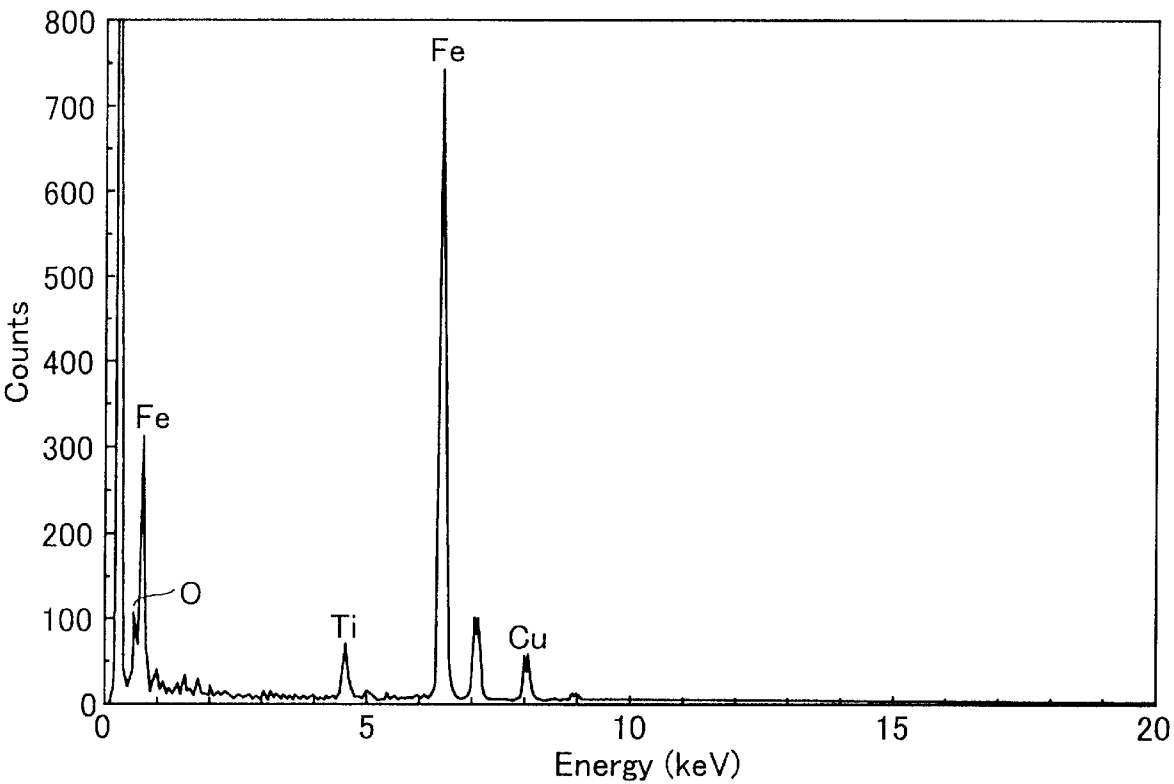
FIG. 7 is a chart of EDX analysis at point No. 5 of the oxide coated fine metal particle shown in the transmission electron micrograph of FIG. 6.
Figure 8:
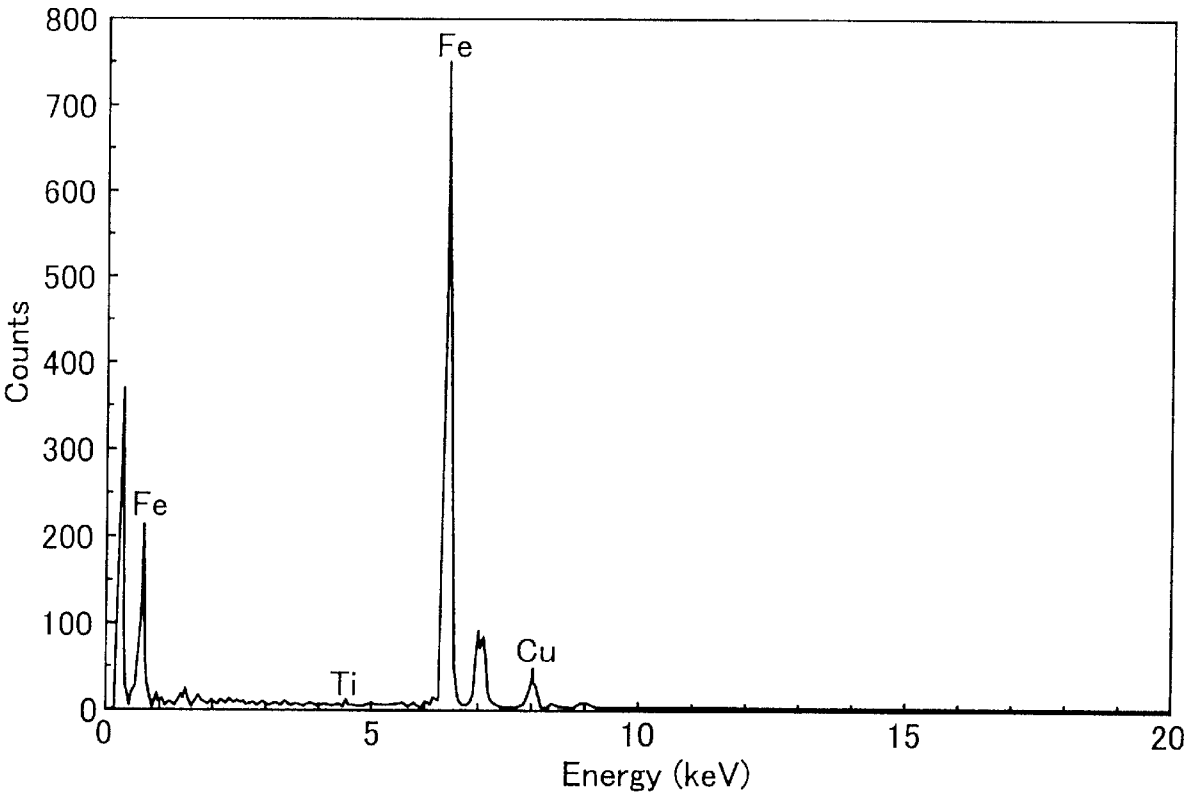
FIG. 8 is a chart of EDX analysis at point No. 6 of the oxide coated fine metal particle shown in the transmission electron micrograph of FIG. 6.

One of the oxide coated fine metal particles 10 that were produced in Example 1 was examined with TEM (transmission electron microscope) and the micrograph taken is shown FIG. 6. The same particle was subjected to EDX (energy-dispersive X-ray analysis) at point Nos. 5 and 6 and the resulting charts are shown in FIG. 7 (point No. 5) and FIG. 8 (point No. 6).

From FIG. 6, one can see that the single coated particle examined consisted of the core and the coating layer (or film) in a thickness of several nanometers. According to FIG. 8, the core was an Fe particle several tens of nanometers in diameter and it contained neither Ti nor O. Since Fe, Ti and O appear in FIG. 7, it may be concluded that the coating layer (or film) is made of an oxide of Fe and Ti in a thickness of several nanometers; namely, it is not a mere Fe oxide layer but is mainly composed of a complex oxide formed by coalescing between Fe in the core and $TiO_2$ in the coating oxide.

Given these data, one can see that the oxide coated fine metal particles 10 produced in Example 1 had the entire surfaces of the fine core Fe particles 12 covered with the dense and uniform coating layer 14 which was mainly composed of the Fe—Ti—O complex oxide and that said coating-layer 14 had a very uniform thickness.

It is also seen that in accordance with the invention, the oxide coated fine metal particles 10 one of which is shown in FIG. 6 can be produced in an very positive and easy way with high yield.

Example 2

A Ni powder material 22 having an average particle size of 6 $\mu$m and a $BaTiO_3$ powder material 24 having an average particle size of 0.5 $\mu$m were charged into the same apparatus 40 as used in Example 1 and processed as in Example 1 in accordance with the same production line 20 as in Example 1 to produce $BaTiO_3$-coated fine Ni particles 10.

The $BaTiO_3$ powder material 24 and the Ni powder material 22 were supplied in such a ratio that the proportion of the $BaTiO_3$ powder material 24 was 5 wt % (7.3 vol %).

The other conditions of the production in Example 2 were completely identical to those employed in Example 1.

By the above-described procedure, oxide coated fine metal particles 10 could be produced in high yield. They comprised the fine core Ni particles 12 having an average size of 0.3 $\mu$m that were covered with the oxide coating layer 14 in an average thickness of 3 nm which joined tightly and strongly (ruggedly) to the surfaces of the fine Ni particles 12.

Figure 9:
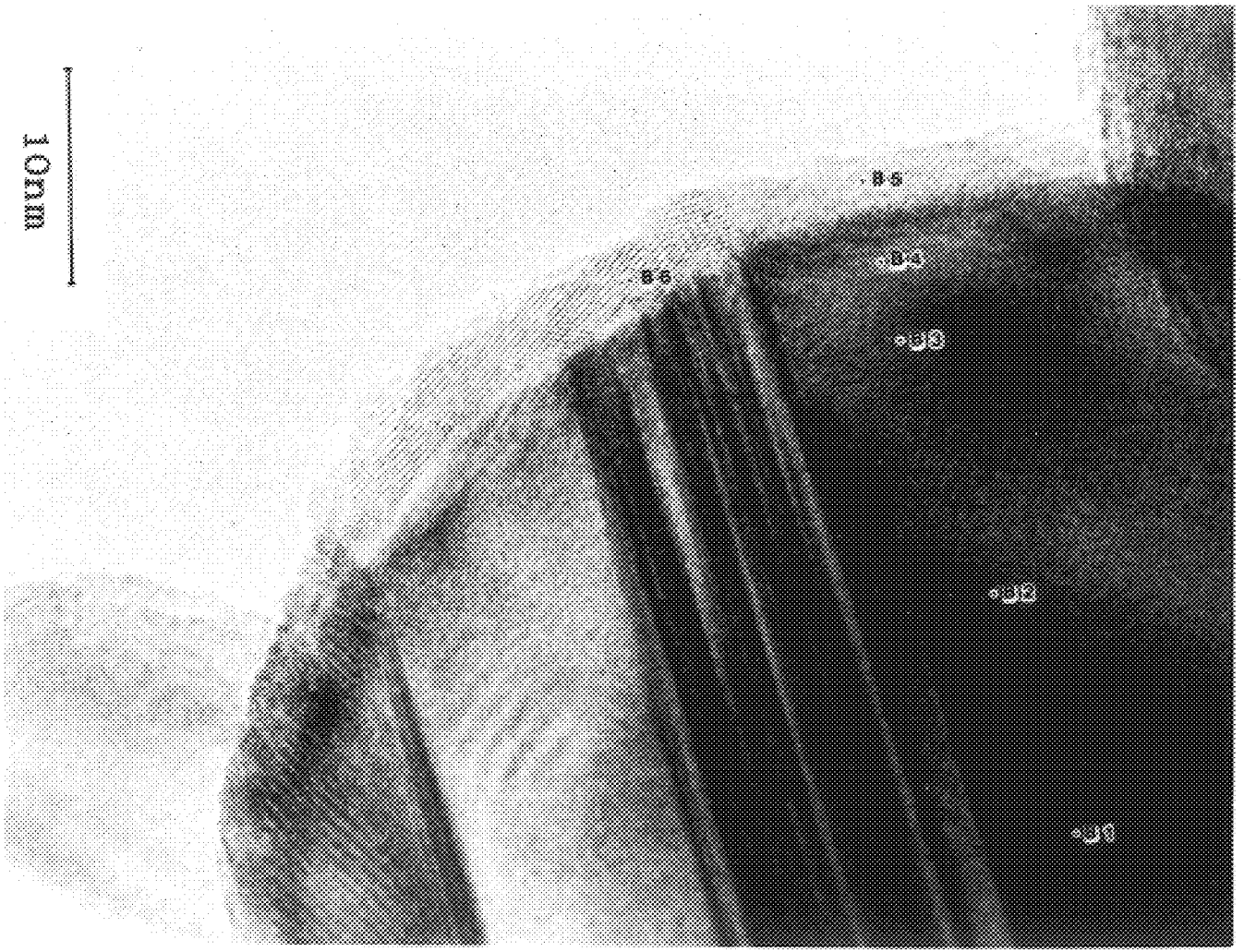
FIG. 9 is a transmission electron micrograph of one of the oxide coated fine metal particles prepared in Example 2 of the invention.
Figure 10:
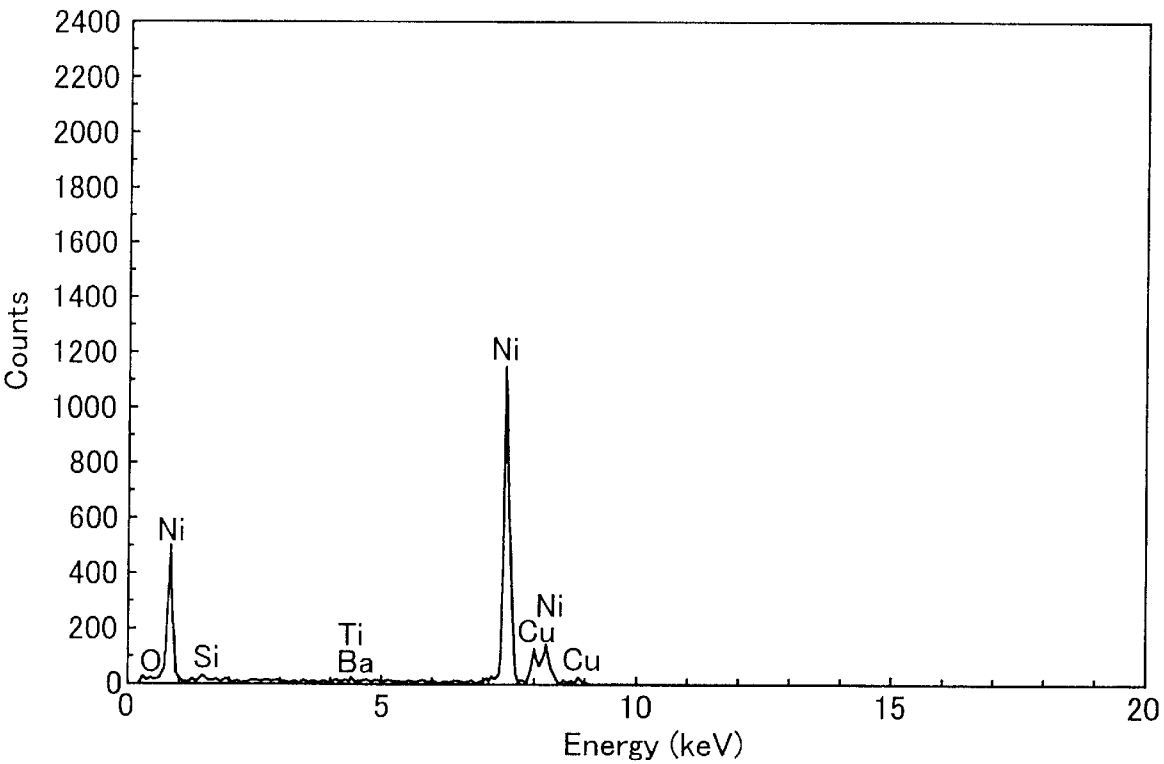
FIG. 10 is a chart of EDX analysis at point B1 of the oxide coated fine metal particle shown in FIG. 9.

One of the oxide coated fine metal particles 10 that were produced in Example 2 was examined with TEM (transmission electron microscope) and the micrograph taken is shown FIG. 9. The same particle was subjected to EDX (energy-dispersive x-ray analysis) at points B1 and B6 and the resulting charts are shown in FIGS. 10 (point B1) and 11 (point B6).

Figure 11:
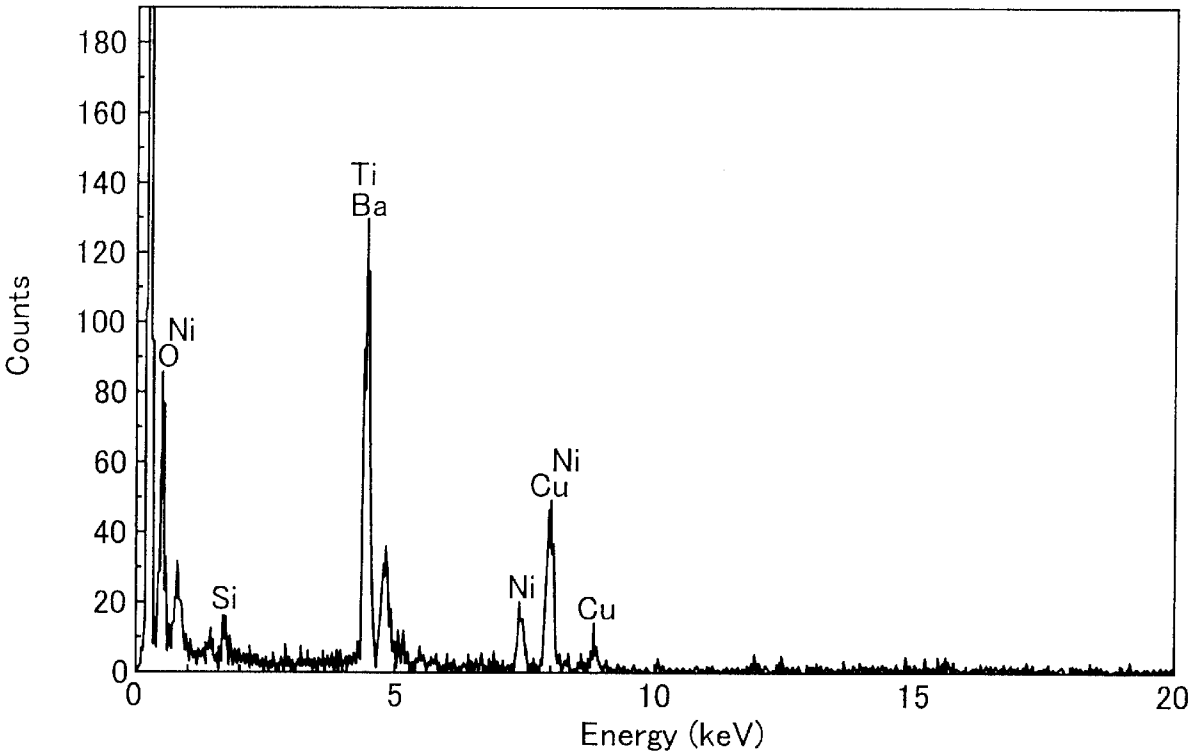
FIG. 11 is a chart of EDX analysis at point B6 of the oxide coated fine metal particle shown in FIG. 9.

From FIG. 9, one can see that the single coated particle examined consisted of the core and the coating layer (or film) in a thickness of several nanometers. According to FIG. 10, the core was a Ni particle several hundred nanometers in diameter and it did not contain Ba, Ti or O. Since Ba, Ti and O appear in FIG. 11, it may be concluded that the coating layer (or film) is made of an oxide of Ba and Ti in a thickness of several nanometers; namely, it is a complex oxide ($BaTiO_3$) layer solely composed of the coating oxide free from the Ni component of the core.

Given these data, one can see that the oxide coated fine metal particles 10 produced in Example 2 had the entire surfaces of the fine core Ni particles 12 covered with the dense and uniform coating layer 14 which was composed of the Ba—Ti—O complex oxide and that said coating layer 14 had a very uniform thickness.

It is also seen that in accordance with the invention, the oxide coated fine metal particles 10 one of which is shown in FIG. 9 can be produced in an very positive and easy way with high yield.

What is claimed is:

1. A process for producing oxide coated fine metal particles, comprising the steps of:

mixing a metal powder material with an oxide powder material of at least one member selected from the group consisting of an oxide, a complex oxide and an oxy-acid salt, wherein each of said oxide, said complex oxide and said oxy-acid salt does not contain as a main component a metal element which is a main component of the metal powder material, thereby to obtain a powder material mixture, wherein said mixing step comprises a compositing sub-step of compositing said metal powder material and said oxide powder material to produce as the powder material mixture composite particles in which particles in the metal powder material do not agglomerate together but are individually covered on respective entire surfaces with a multiple of particles in the oxide powder material that have been dispersed and attached and/or adhered;

supplying the powder material mixture into a thermal plasma to make a vapor-phase mixture; and then quenching the vapor-phase mixture to form said oxide coated fine metal particles which comprise:

core particles made of fine elemental metal particles that are finer than said metal powder material; and a coating layer with which said core particles are covered;

wherein said coating layer comprises at least one member selected from the group consisting of:

(1) said oxide;

(2) said complex oxide;

(3) said oxy-acid salt;

(4) a complex compound of said oxide or said complex oxide or said oxy-acid salt, and an oxide of said metal element; and (5) a complex salt of said oxide or said complex oxide or said oxy-acid salt, and said oxide of said metal element.

2. The process according to claim 1, wherein said core particles have an average size of 0.01–1 $\mu$m and said coating layer has an average thickness of 1–10 nm.

3. The process according to claim 1, wherein the metal element which is the main component of said fine core metal particles is at least one member of the group consisting of Al, Ti, V, Cr, Fe, Co, Ni, Mn, Cu, Zn, Zr, Ru, Pd, Ag, In, Pt, Au and Sm, and wherein the oxide, the complex oxide or the oxy-acid salt with which said fine core metal particles are coated is at least one member of the group consisting of titanium oxide, zirconium oxide, calcium oxide, silicon oxide, aluminum oxide, silver oxide, iron oxide, magnesium oxide, manganese oxide, yttrium oxide, cerium oxide, samarium oxide, beryllium oxide, barium titanate, lead titanate, lithium aluminate, yttrium vanadate, calcium phosphate, calcium zirconate, lead titanate zirconate, iron titanium oxide, cobalt titanium oxide and barium stannate.

4. The process according to claim 1, wherein said metal powder material has an average particle size of 0.5–20 $\mu$m and said oxide powder material has an average particle size of 0.1–1 $\mu$m.

5. The process according to claim 1, wherein said compositing sub-step comprises compositing said metal powder material and said oxide powder material with a high-speed shear and impact mixer or a milling mixer.

6. The process according to claim 1, wherein said mixing step further comprises a premixing sub-step of mixing uniformly said metal powder material and said oxide powder material prior to said compositing sub-step to prepare a uniform premix of the metal powder material and the oxide powder material, and said compositing sub-step comprises compositing said uniform premix of said metal powder material and said oxide powder material to produce as the powder material mixture, an aggregate of composite particles having the individual particles in said metal powder material coated with the multiple particles in said oxide powder material.

7. The process according to claim 6, wherein said premixing sub-step comprises mixing uniformly said metal powder material and said oxide powder material with a V-type mixer or a double-cone mixer.

8. The process according to claim 1, wherein said thermal plasma has a higher temperature than boiling points of said metal powder material and said oxide powder material.

9. The process according to claim 1, wherein said thermal plasma is in an atmosphere at 760 mmHg or below.

10. The process according to claim 1, wherein said thermal plasma is in an atmosphere at 200–600 Torr.

11. The process according to claim 1, wherein said vapor-phase mixture is quenched in an inert or reducing atmosphere.

12. The process according to claim 1, wherein said vapor-phase mixture is quenched in an atmosphere containing a rare gas either independently or in admixture with hydrogen.

* * * * *